US007075399B2

(12) United States Patent
Saban et al.

(10) Patent No.: US 7,075,399 B2
(45) Date of Patent: Jul. 11, 2006

(54) LIQUID-COOLED INDUCTIVE DEVICES WITH INTERSPERSED WINDING LAYERS AND DIRECTED COOLANT FLOW

(75) Inventors: Daniel M. Saban, Rockford, IL (US); Timothy R. Cejka, Loves Park, IL (US); Robert Scott Downing, Rockford, IL (US); Joshua J. Krecklow, Leaf River, IL (US); Steven C. Paul, Rockford, IL (US)

(73) Assignee: Hamilton Sunstrand Corporation, Windsor Locks, CT (US)

( * ) Notice: Subject to any disclaimer, the term of this patent is extended or adjusted under 35 U.S.C. 154(b) by 191 days.

(21) Appl. No.: 10/809,099

(22) Filed: Mar. 23, 2004

(65) Prior Publication Data

US 2004/0189429 A1 Sep. 30, 2004

Related U.S. Application Data

(60) Provisional application No. 60/458,788, filed on Mar. 28, 2003.

(51) Int. Cl.
*H01F 27/08* (2006.01)

(52) U.S. Cl. ..... 336/60

(58) Field of Classification Search ..... 336/55–60, 336/180–183, 206–208; 417/372
See application file for complete search history.

(56) References Cited

U.S. PATENT DOCUMENTS 3,188,833 A * 6/1965 Robinson ..... 62/505
3,593,243 A * 7/1971 Trump et al. ..... 336/60
3,663,127 A * 5/1972 Cheers ..... 417/372

* cited by examiner

*Primary Examiner*—Tuyen Nguyen
(74) *Attorney, Agent, or Firm*—Stephen G. Mican

(57) ABSTRACT

A high-power, liquid-cooled, multi-layer winding inductive device that has a region of interspersed winding layers and directed coolant flow over the interspersed windings to improve heat transfer and device life.

19 Claims, 6 Drawing Sheets

LIQUID-COOLED INDUCTIVE DEVICES WITH INTERSPERSED WINDING LAYERS AND DIRECTED COOLANT FLOW

CROSS REFERENCE TO RELATED APPLICATION

This Application claims the benefit of the filing date for prior filed co-pending Provisional Application Ser. No. 60/458,788, filed 28 Mar. 2003.

FIELD OF THE INVENTION

The invention relates to liquid-cooled inductive devices, and more particularly to high-power liquid-cooled inductive devices with multi-layer windings.

BACKGROUND OF THE INVENTION

When high power inductive devices, such as inductors and transformers, are implemented, it is common to bathe such devices in a liquid coolant such as oil to more effectively remove heat generated by losses in the devices. When such devices have multi-layer windings, the innermost layer or layers tend to exhibit significantly higher temperature than the outer layer or layers. This temperature differential causes premature failure of the devices.

SUMMARY OF THE INVENTION

A liquid-cooled device with at least one multi-layer winding, such as an inductor or transformer, is wound so that at least a few turns of the outer layer or layers of the multi-layer winding are embedded or interspersed with the inner layer or layers. This directly exposes the inner layer or layers to the coolant and increases the heat transfer to the coolant, thereby lowering the temperature of the inner layer. Furthermore, a coolant flow diverter is used to force coolant within the region of the interspersed winding layers that form a gap in the outer winding layer or layers of the multi-layer winding.

DESCRIPTION OF THE EMBODIMENT

Figure 9:
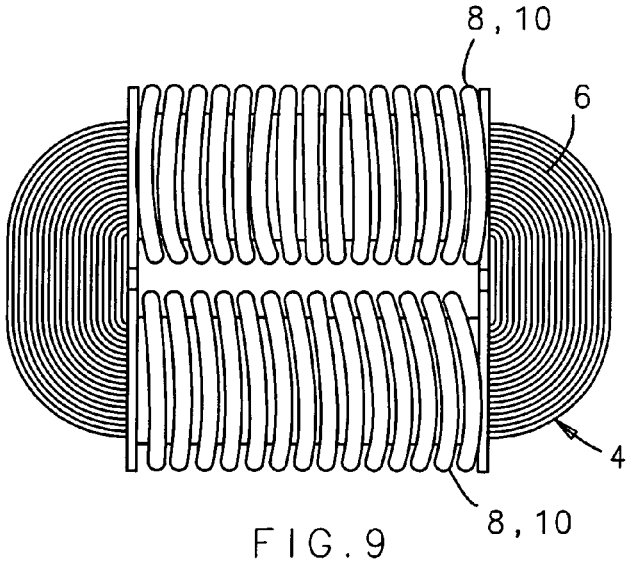
FIG. 9 shows the coil configuration for an inductive device according to the prior art without interspersed winding layers.
Figure 10:
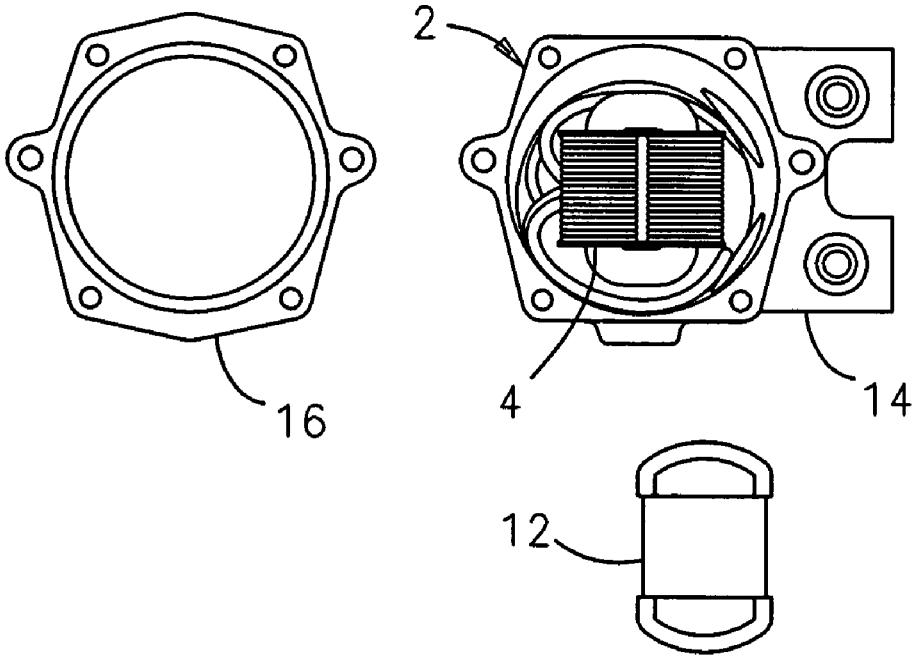
FIG. 10 shows the assembly of an inductive device according to the prior art without directed coolant flow.

FIGS. 9 and 10 show a prior art high-power, liquid-cooled inductive device 2, in this case, a transformer of the inter-phase type that is used to join two three-phase full wave rectified diode bridges to create twelve pulse rectification in aerospace applications. The inductive device 2 has a core-coil assembly 4 with an inductive device core 6 and two multi-layer windings 8. In this case, each multi-layer winding 8 comprises an inner layer (not shown) and an outer layer 10, so no coolant is expected to come directly in contact with the inner layer of each multi-layer winding 8.

FIG. 10 shows that the inductive device 2 lacks any sort of directed coolant flow within the inductive device 2. A spacer 12, shown at the bottom of FIG. 10, fits within the inductive device 2. It serves only to locate the inductive device core 4 with its multi-layer windings 8 in place within a housing 14, shown on the right side of FIG. 10, prior to placing a housing cover 16, shown on the left side of FIG. 10, on the housing 14 to seal the inductive device 2.

Shown in FIGS. 1 through 8 are how a high-power, liquid-cooled inductive device, in this case, a prior art inductive device 2 such as shown in FIGS. 9 and 10, may be adapted to incorporate the interspersed multi-layer winding and the directed coolant flow features according to the invention. Although an inter-phase transformer is described as a specific embodiment, those skilled in the art shall recognise that this invention may be incorporated in any high-power, liquid-cooled inductive device.

Figure 5:
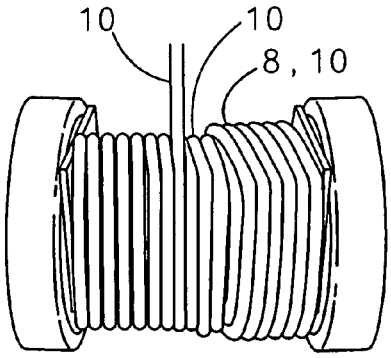
FIG. 5 shows how inner and outer winding layers of a coil for an inductive device according to the invention are interspersed.
Figure 6:
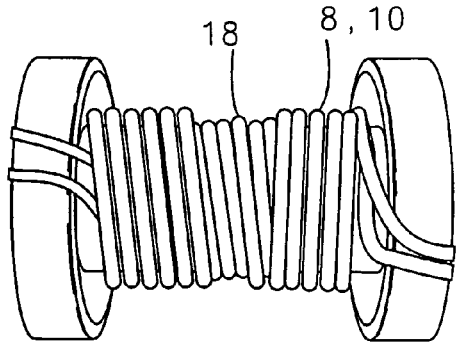
FIG. 6 shows the completed inductive device coil for an inductive device according to the invention.
Figure 7:
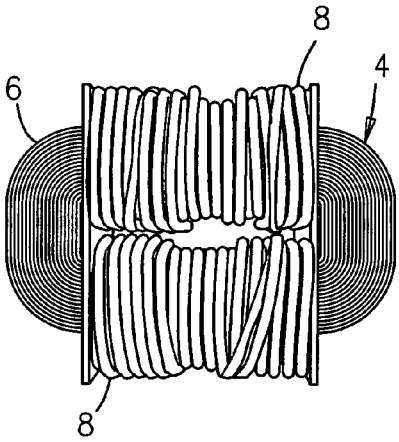
FIG. 7 shows two of the completed inductive device coils of FIG. 6 assembled on a core for an inductive device according to the invention.
Figure 8:
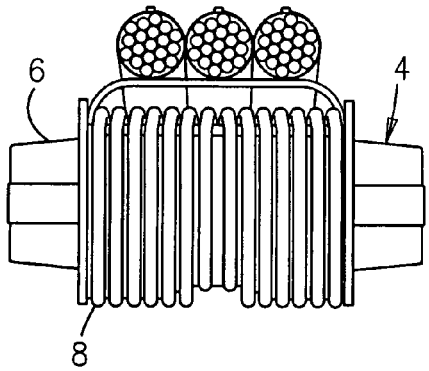
FIG. 8 shows a side view of the impregnated core with coils for an inductive device according to the invention.

The primary purpose of the invention is to direct coolant, in this case oil, over all the winding layers of the inductive device 2 such that the heat transfer, especially of the inner layer of each multi-layer winding 8, is increased. To that end, a few turns of the outer layer 10 of each multi-layer winding 8 are embedded or interspersed between those of the inner layer, as shown in FIG. 5, to create an interspersed central section 18 that forms a gap between the ends of the outer layer 10 in the multi-layer winding 8, as shown in FIG. 6. The multi-layer windings 8 are then mounted on the inductive device core 6 to form the coil-core assembly 4, as shown in FIG. 7, and then the coil-core assembly 4 is impregnated, as shown in FIG. 8.

Figure 1:
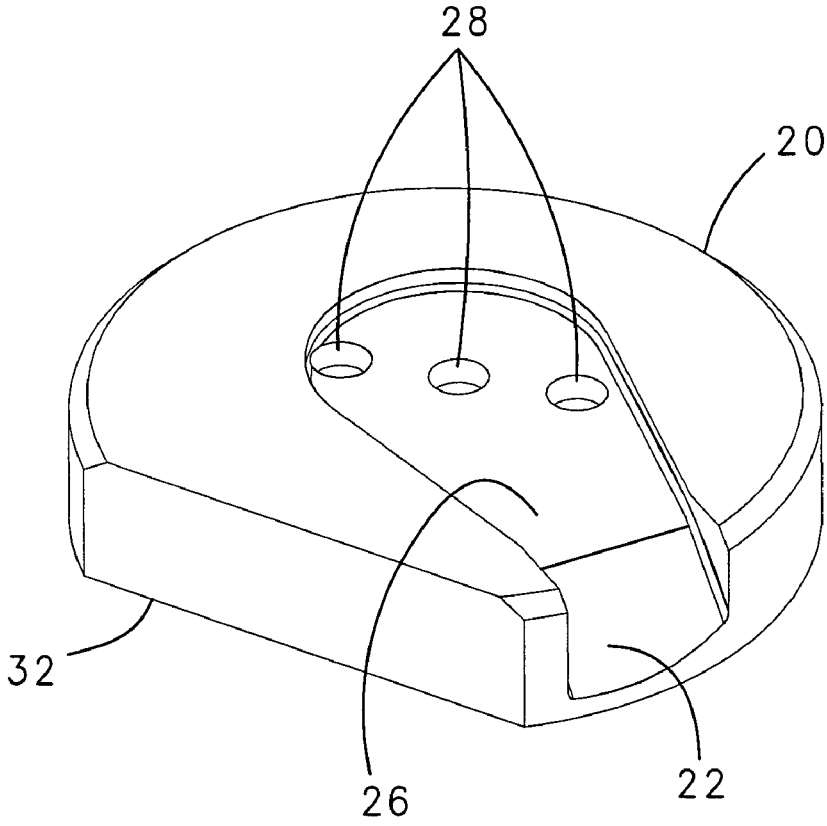
FIG. 1 shows a top view of an oil diverter according to the invention.
Figure 2:
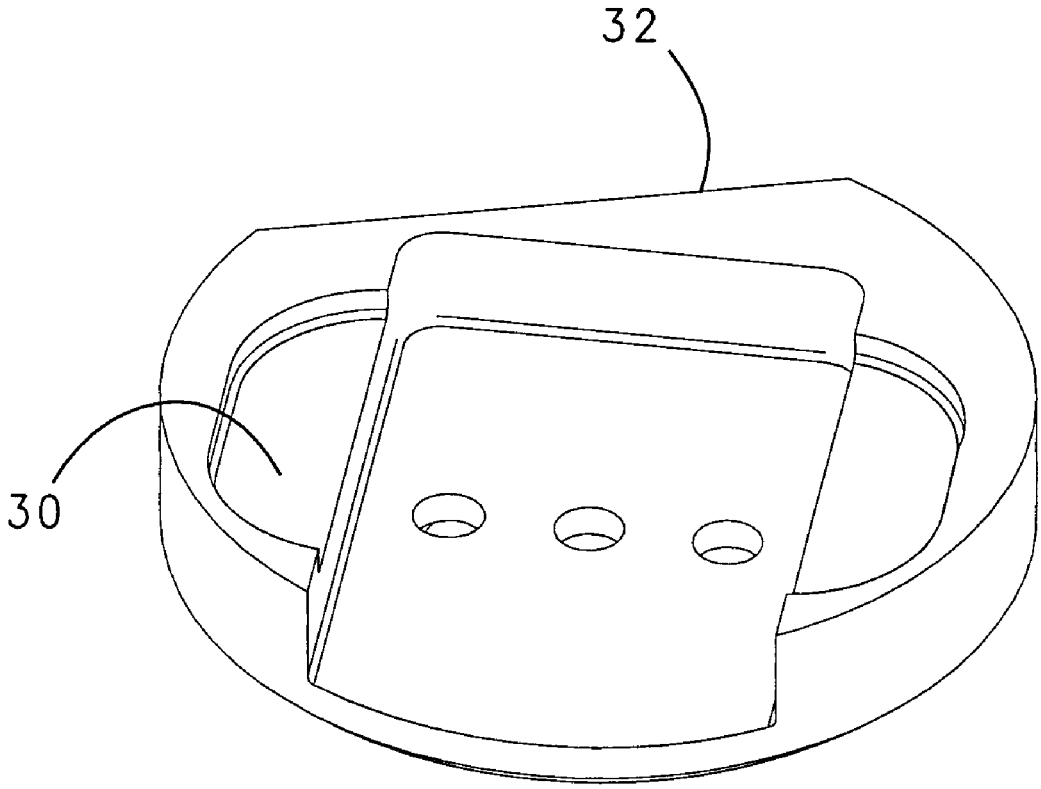
FIG. 2 shows a bottom view of an oil diverter according to the invention.
Figure 3:
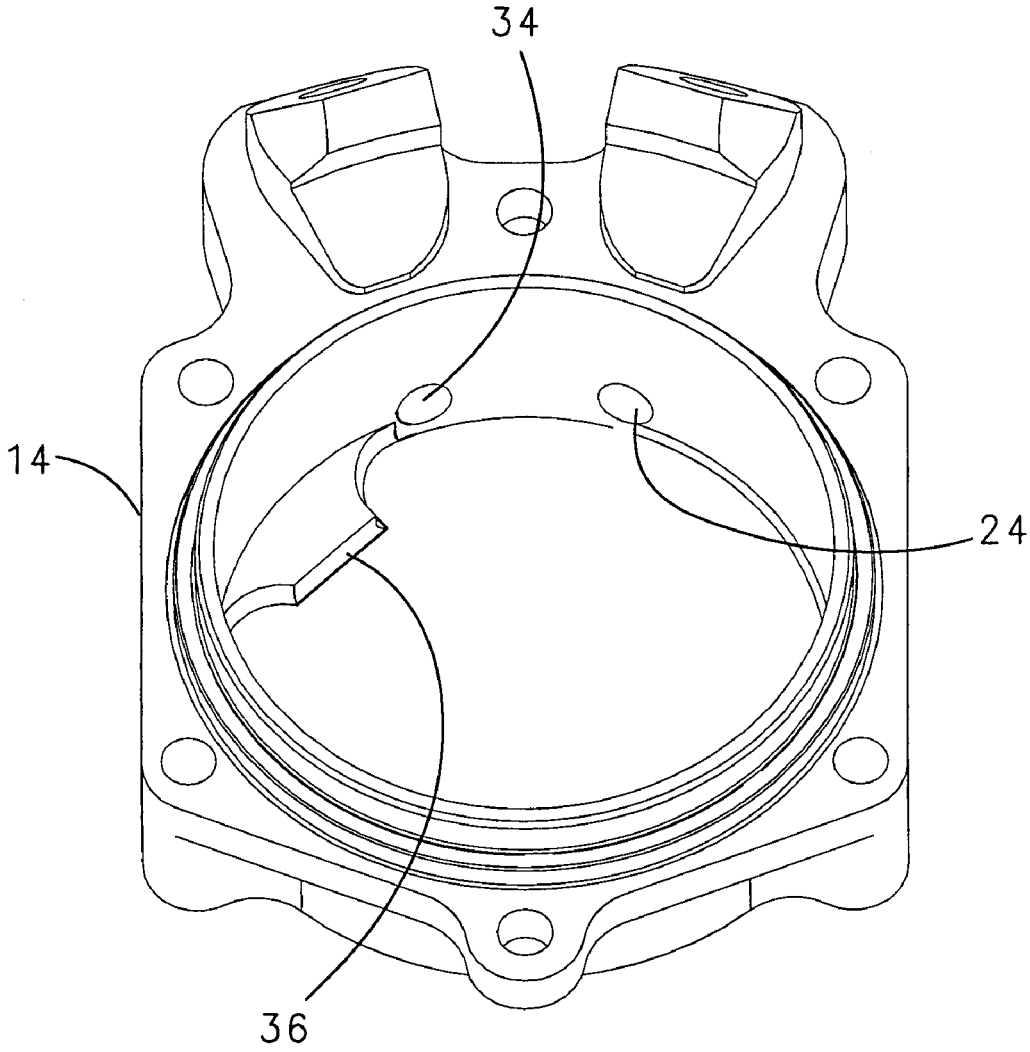
FIG. 3 shows the cover side of a housing for an inductive device according to the invention, minus its cover.
Figure 4:
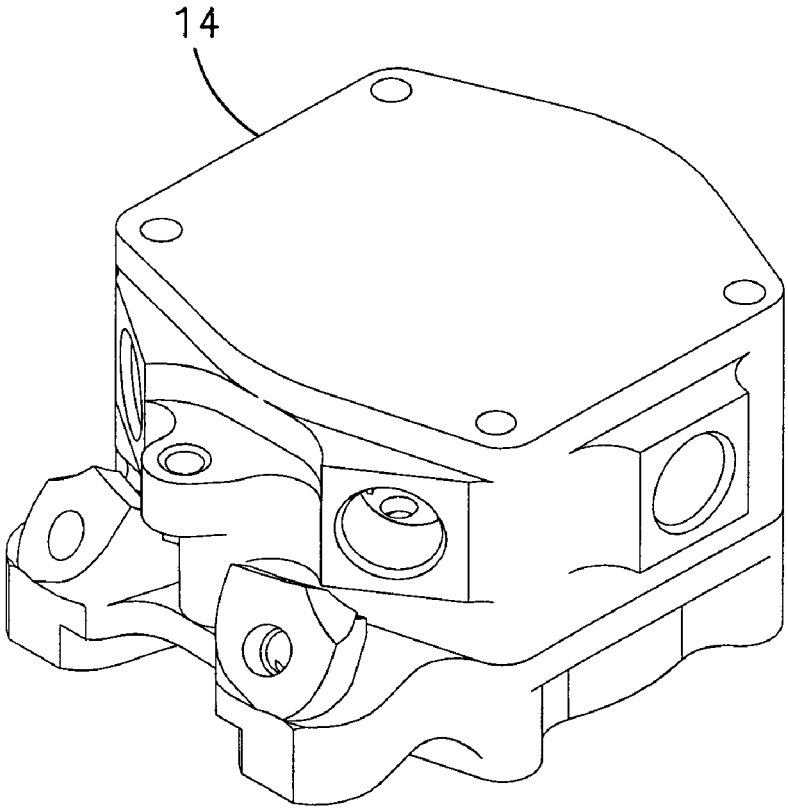
FIG. 4 shows the housing of FIG. 3 with its cover, opposite its cover side.

A flow diverter 20 according to the invention is shown in FIGS. 1 and 2. The flow diverter 20 is sized with tight tolerances so that the vast majority of the coolant is forced between the top of the housing 14 and the flow diverter 20 itself. The flow diverter 20 is machined from a suitable high-temperature material with good electrical insulation properties, such as polyamide-imide plastic, commonly known as Torlon®. Referring to FIGS. 1 and 3 together, the flow diverter 20 is formed to sit in the housing 14 such that a ramp 22 interfaces a coolant inlet port 24 of the housing 14 with an inlet channel 26 that leads to a plurality of holes that penetrate through the flow diverter 20, such as the three holes 28 shown in FIGS. 1 and 2. The holes 28 serve to force the coolant down through the interspersed central sections 18 of the multi-layer windings 8.

The flow diverter 20 is also machined with a large cut-out 30, as shown in FIG. 2, that serves to seat the core-coil assembly 4 and direct the coolant to circulate around the core-coil assembly. The flow diverter 20 also has a flat 32 cut into its side that is aligned to couple with an outlet port 34 in the housing 14. The flat 32 serves as an outlet channel that allows coolant that circulates around the core-coil assembly 4 to exit from the outlet port 34. Preferably, the housing 14 has an interior tab 36 that mates with the flat 32 and provides an anti-rotation feature that keeps the flow diverter 20 and core-coil assembly 4 in alignment within the housing 14.

Although an inter-phase transformer is described as a specific embodiment, those skilled in the art shall recognise that this invention may be incorporated in any high-power, liquid-cooled inductive device. In particular, the multi-layer winding 8 may have more than two layers, wherein the several layers are embedded or interspersed in the interspersed central section 18 to similarly form a gap between the ends of the outer layer 10, thus providing superior cooling of the inner layers in a similar fashion. Furthermore, the core-coil assembly 4 may include one or more multi-layer windings 8 so that any high-power inductive device may use this invention.

Thus there has been described herein a high-power, liquid-cooled, multi-layer winding inductive device that has a region of interspersed winding layers and directed coolant flow over the interspersed windings to improve heat transfer and device life. It should be understood that the embodiment described above is only one illustrative implementation of the invention and that the various parts and arrangement thereof may be changed or substituted.

What is claimed is:

1. An inductive device with superior power handing capacity, comprising:

an inductive device housing with a coolant inlet port and a coolant outlet port;

an inductive device core;

at least one multi-layer winding wound around the core that has a central section about which a portion of all the layers are interspersed so that they form a gap in the outer layer or layers of each multi-layer winding; and a flow diverter that directs coolant flow from the inlet port through the central section of each multi-layer winding.

2. The inductive device of claim 1, wherein the flow divider seats the core and each multi-layer winding in place within the housing.

3. The inductive device of claim 2, wherein the flow divider includes a plurality of holes through which coolant from the inlet port sprays the central section of each multi-layer winding.

4. The inductive device of claim 3, wherein the flow divider has an inlet channel that couples the holes to the inlet port.

5. The inductive device of claim 4, wherein the flow divider has a ramp that interfaces the inlet port with the inlet channel.

6. The inductive device of claim 5, wherein the flow divider has an outlet channel that couples coolant circulating around the core and each multi-layer winding with the outlet port.

7. The inductive device of claim 6, wherein each multi-layer winding has an inner layer and an outer layer.

8. The inductive device of claim 7, wherein two multi-layer windings are wound around the core.

9. The inductive device of claim 6, wherein the outlet channel comprises a flat cut into the side of the flow divider and the housing includes an interior locating tab that mates with the flat and keeps the flow diverter, core and each multi-layer winding in alignment within the housing.

10. The inductive device of claim 9, wherein each multi-layer winding has an inner layer and an outer layer.

11. The inductive device of claim 10, wherein two multi-layer windings are wound around the core.

12. An inductive device with superior power handing capacity, comprising:

an inductive device housing with a coolant inlet port and a coolant outlet port;

an inductive device core;

at least one multi-layer winding wound around the core that has a central section about which a portion of all the layers are interspersed so that they form a gap in the outer layer or layers of each multi-layer winding; and a flow diverter that directs coolant flow from the inlet port through the central section of each multi-layer winding that comprises a plurality of holes through which coolant from the inlet port sprays the central section of each multi-layer winding, an inlet channel that couples the holes to the port and an outlet channel that couples coolant circulating around the core and each multi-layer winding with the outlet port.

13. The inductive device of claim 12, wherein the flow divider has a ramp that interfaces the inlet port with the inlet channel.

14. The inductive device of claim 13, wherein the outlet channel comprises a flat cut into the side of the flow divider and the housing includes an interior locating tab that mates with the flat and keeps the flow diverter, core and each multi-layer winding in alignment within the housing.

15. The inductive device of claim 14, wherein each multi-layer winding has an inner layer and an outer layer.

16. The inductive device of claim 15, wherein two multi-layer windings are wound around the core.

17. An inductive device with superior power handing capacity, comprising:

an inductive device housing with a coolant inlet port and a coolant outlet port;

an inductive device core;

at least one winding with an inner layer and an outer layer wound around the core that has a central section about which a portion of the inner and outer layers are interspersed so that they form a gap in the outer layer of each multi-layer winding; and a flow diverter that directs coolant flow from the inlet port through the central section of each multi-layer winding that comprises a plurality of holes through which coolant from the inlet port sprays the central section of each multi-layer winding, an inlet channel that couples the holes to the port and an outlet channel that couples coolant circulating around the core and each multi-layer winding with the outlet port.

18. The inductive device of claim 17, wherein the flow divider has a ramp that interfaces the inlet port with the inlet channel.

19. The inductive device of claim 18, wherein the outlet channel comprises a flat cut into the side of the flow divider and the housing includes an interior locating tab that mates with the flat and keeps the flow diverter, core and each multi-layer winding in alignment within the housing.

* * * * *

UNITED STATES PATENT AND TRADEMARK OFFICE

CERTIFICATE OF CORRECTION

PATENT NO. : 7,075,399 B2
APPLICATION NO. : 10/809099
DATED : July 11, 2006
INVENTOR(S) : Daniel M. Saban et al.

It is certified that error appears in the above-identified patent and that said Letters Patent is hereby corrected as shown below:

On Title page (item 73)

Assignee should read
-- Hamilton Sundstrand Corporation, Windsor Locks, CT --

Signed and Sealed this

Seventh Day of November, 2006

JON W. DUDAS
*Director of the United States Patent and Trademark Office*